US008875523B2

(12) United States Patent
Fukuda

(10) Patent No.: US 8,875,523 B2
(45) Date of Patent: Nov. 4, 2014

(54) CRYOPUMP AND EVACUATION METHOD

(75) Inventor: Tsutomu Fukuda, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 211 days.

(21) Appl. No.: 13/443,449

(22) Filed: Apr. 10, 2012

(65) Prior Publication Data

US 2012/0260675 A1 Oct. 18, 2012

(30) Foreign Application Priority Data

Apr. 14, 2011 (JP) ..... 2011-090347

(51) Int. Cl.
*F25D 25/00* (2006.01)
*F04B 37/14* (2006.01)
*F04B 37/02* (2006.01)

(52) U.S. Cl.
CPC ..... *F04B 37/14* (2013.01); *F04B 37/02* (2013.01)
USPC ..... 62/62

(58) Field of Classification Search
USPC ..... 62/62, 55.5; 29/888.02
See application file for complete search history.

(56) References Cited

U.S. PATENT DOCUMENTS 4,449,373 A * 5/1984 Peterson et al. ..... 62/55.5
6,053,704 A * 4/2000 Yamamoto et al. ..... 417/52

FOREIGN PATENT DOCUMENTS

JP 2000-249056 A 9/2000
JP 2003-178708 A 6/2003
JP 2009-108744 A 5/2009

OTHER PUBLICATIONS

Office Action issued in Japanese Application No. 2011-090347, dated May 20, 2014.

* cited by examiner

*Primary Examiner* — Melvin Jones
(74) *Attorney, Agent, or Firm* — Rader, Fishman & Grauer PLLC

(57) ABSTRACT

A cryopump includes a refrigerator which cools a cryopanel and a controller which receives a control signal representing an operation mode from a beam irradiating apparatus and controls the refrigerator based on the control signal. The operation mode includes an irradiation mode for irradiating a beam to a target and an idle mode for diverting the beam from the target or keeping the beam with a level weaker than that of the irradiation mode. The controller controls the refrigerator such that the cryopanel is cooled in both the irradiation mode and the idle mode to a cooling temperature at which gas molecules are held and allows the cooling temperature in at least a part of the period of the idle mode to be higher than that of the irradiation mode.

3 Claims, 5 Drawing Sheets

CRYOPUMP AND EVACUATION METHOD

BACKGROUND OF THE INVENTION

1. Field of the Invention

The present invention relates to a cryopump and an evacuation method.

2. Description of the Related Art

A cryopump is a vacuum pump which captures gas molecules on a cryopanel cooled to an extremely low temperature by condensation or adsorption and evacuates the gas molecules. The cryopump is generally used to realize a clean vacuum environment which is demanded in a semiconductor circuit manufacturing process and the like. For example, a cryopump suitable for an ion implantation apparatus is known. It is desirable to configure the cryopump such that a high performance of pumping is realized with low power consumption.

SUMMARY OF THE INVENTION

An aspect of the present invention is a cryopump for use in evacuation of a beam path in a beam irradiating apparatus. The apparatus is configured to irradiate a beam to a target. The cryopump includes: a cryopanel configured to capture gas molecules on a surface thereof; a refrigerator configured to cool the cryopanel; and a control unit configured to receive a control signal from the beam irradiating apparatus representing an operation mode thereof and to control the refrigerator based on the control signal. The operation mode includes an irradiation mode for irradiating a beam to a target and an idle mode for diverting the beam away from the target or keeping the beam with a level weaker than that of the irradiation mode. The control unit controls the refrigerator such that the cryopanel is cooled to a cooling temperature at which the gas molecules are held in both the irradiation mode and the idle mode. The control unit allows the cooling temperature in at least a part of the period of the idle mode to be higher than that of the irradiation mode.

Another aspect of the invention is a method of evacuating a beam path using a cryopump. The method includes: irradiating a beam to a target; and, instead of irradiating the beam to the target, keeping the beam by diverting the beam away from the target, or keeping the beam in the path with an intensity lower than that of the beam irradiated to the target. The method further includes setting the pumping speed of the cryopump in at least a part of the period of the keeping of the beam to be lower than that of the cryopump when the beam is irradiated to the target.

DETAILED DESCRIPTION OF THE INVENTION

The invention will now be described by reference to the preferred embodiments. This does not intend to limit the scope of the present invention, but to exemplify the invention.

One of exemplary objects of the aspects of the invention is to provide a cryopump which contributes to a reduction in the power consumption and an evacuation method using the cryopump.

According to an aspect of the invention, there is provided a cryopump which is used to evacuate a beam path in a beam irradiating apparatus irradiating a beam to a target, the cryopump including: a cryopanel which captures gas molecules on a surface thereof; a refrigerator which cools the cryopanel; and a control unit which receives a control signal from the beam irradiating apparatus representing an operation mode thereof and controls the refrigerator based on the control signal, wherein the operation mode includes an irradiation mode which irradiates a beam to a target and an idle mode which diverts the beam away from the target or keeps the beam with a level weaker than that of the irradiation mode, and wherein the control unit controls the refrigerator such that the cryopanel is cooled to a cooling temperature at which the gas molecules are held in both the irradiation mode and the idle mode, and allows the cooling temperature in at least a part of the period of the idle mode to be higher than that of the irradiation mode.

According to this aspect, the temperature of the cryopanel may be allowed to become higher in the idle mode in which the high-speed pumping is not necessarily needed. Since the load of the refrigerator is reduced, the power consumption may be reduced.

Figure 1:
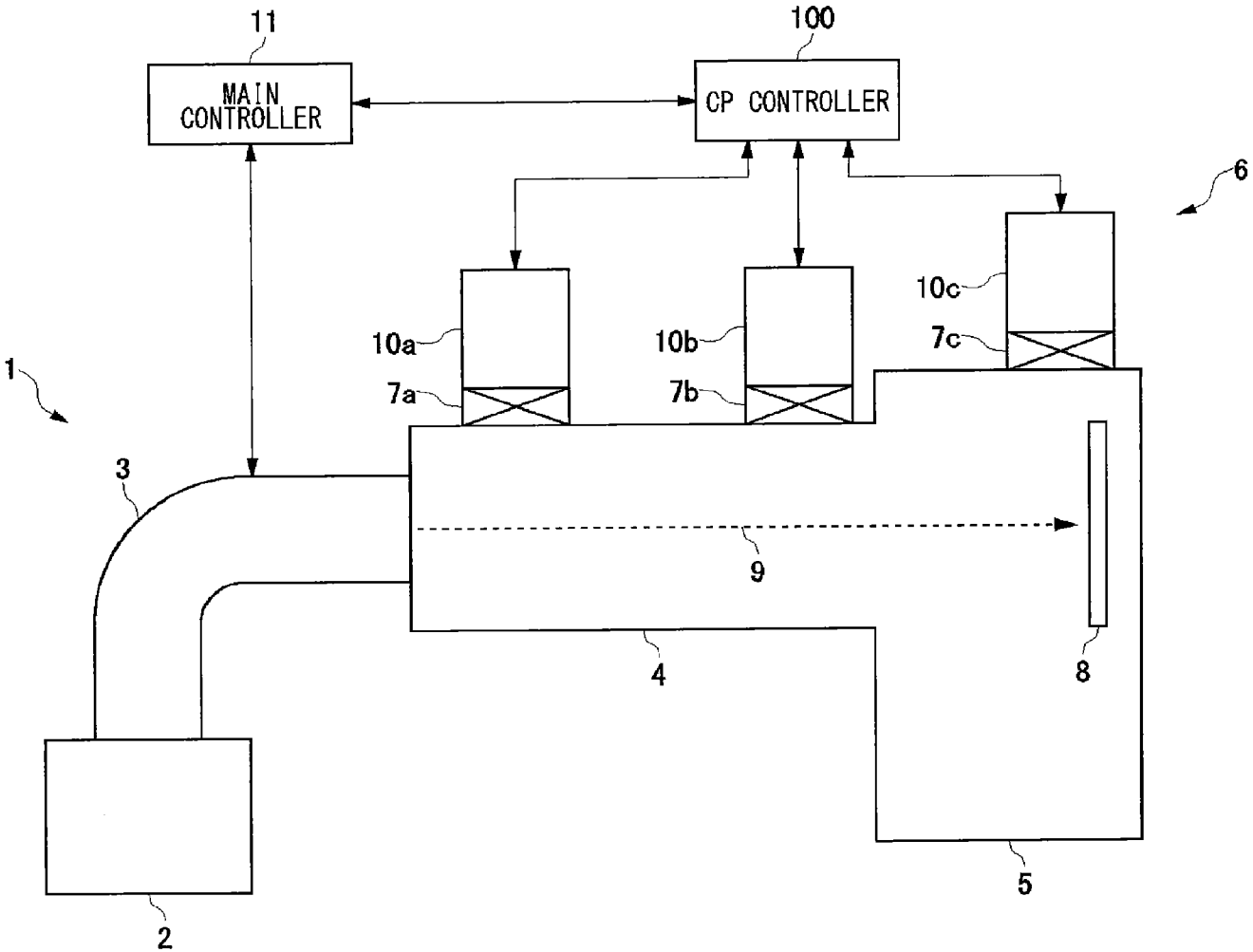
FIG. 1 is a diagram schematically illustrating an ion implantation apparatus and a cryopump according to an embodiment of the invention.

FIG. 1 is a diagram schematically illustrating an ion implantation apparatus 1 and a cryopump 10 according to an embodiment of the invention. The ion implantation apparatus 1, which is an example of a beam irradiating apparatus used to irradiate a beam to a target, includes an ion source unit 2, a mass analyzer 3, a beam line unit 4, and an end station unit 5.

The ion source unit 2 is configured to ionize an element to be implanted into a surface of a substrate and output the ionized element as an ion beam. The mass analyzer 3 is provided at the downstream of the ion source unit 2, and is configured to select necessary ions from the ion beam.

The beam line unit 4 is provided at the downstream of the mass analyzer 3, and includes a lens system which shapes the ion beam and a scanning system which scans the ion beam over the substrate. The end station unit 5 is provided at the downstream of the beam line unit 4, and includes a substrate holder (not illustrated) which holds a substrate 8 corresponding to an ion implantation process target, that is, an irradiation target, a driving system which drives the substrate 8 with respect to the ion beam, and the like. A beam path 9 in the beam line unit 4 and the end station unit 5 is schematically indicated by the dashed arrow.

Further, the ion implantation apparatus 1 is provided with an evacuation system 6. The evacuation system 6 is provided so as to maintain a desired high vacuum (for example, a vacuum higher than $10^{-5}$ Pa) from the ion source unit 2 to the end station unit 5. The evacuation system 6 includes cryopumps 10*a*, 10*b*, and 10*c*.

For example, the cryopumps 10*a* and 10*b* are attached to the cryopump attachment opening of the vacuum chamber wall surface of the beam line unit 4 for the purpose of the evacuation in the vacuum chamber of the beam line unit 4. The cryopump 10*c* is attached to the cryopump attachment opening of the vacuum chamber wall surface of the end station unit 5 for the purpose of the evacuation in the vacuum chamber of the end station unit 5. Furthermore, the evacuation system 6 maybe formed such that both the beam line unit 4 and the end station unit 5 are evacuated by one cryopump 10. Further, the evacuation system 6 may be formed such that the beam line unit 4 and the end station unit 5 are respectively evacuated by the plurality of cryopumps 10.

The cryopumps 10*a* and 10*b* are attached to the beam line unit 4 on gate valves 7*a* and 7*b* , respectively. The cryopump 10*c* is attached to the end station unit 5 on a gate valve 7*c*. Furthermore, in the following description, the cryopumps 10*a*, 10*b*, and 10*c* are collectively referred to as the cryopump 10, and the gate valves 7*a*, 7*b*, and 7*c* collectively referred to as the gate valve 7. During the operation of the ion implantation apparatus 1, the gate valve 7 is open and the evacuation using the cryopump 10 is performed. The gate valve 7 is closed when the cryopump 10 is regenerated.

Furthermore, the evacuation system 6 may further include a turbo-molecular pump and a dry pump which are used to maintain the ion source unit 2 in the high vacuum state. Further, the evacuation system 6 may include a roughing pump which is provided in parallel to the cryopump 10 so as to evacuate the beam line unit 4 and the end station unit 5 from the atmospheric pressure to the pressure at which the operation of the cryopump 10 is started.

The gas which is present in the beam line unit 4 and the end station unit 5 and the gas which is introduced thereinto are evacuated by the cryopump 10. Most of the gas to be evacuated is generally a hydrogen gas. The gas which includes the hydrogen gas is evacuated from the beam path 9 using the cryopanel of the cryopump 10. Furthermore, the gas to be evacuated may include a dopant gas or a by-product gas in the ion implantation process.

The ion implantation apparatus 1 includes a main controller 11 which controls the apparatus. Further, the cryopump 10 is provided with a cryopump controller (hereinafter, simply referred to as a 'CP controller') 100 which controls the cryopump 10. The main controller 11 may be regarded as an upper level controller which generally controls the cryopump 10 through the CP controller 100. The main controller 11 and the CP controller 100 respectively include a CPU which executes various calculation processes, ROM which stores various control programs, RAM which is used as a work area for storing data or executing a program, an input and output interface, memory, and the like. The main controller 11 and the CP controller 100 are connected to each other so as to be able to communicate with each other.

The CP controller 100 is provided separately from the cryopump 10, and controls each of the plurality of cryopumps 10. Each of the cryopumps 10*a*, 10*b*, and 10*c* may be provided with an IO module 50 (see FIG. 3) which performs an input and output process while communicating with the CP controller 100. Furthermore, the CP controller 100 may be individually provided in each of the cryopumps 10*a*, 10*b*, and 10*c*.

Figure 2:
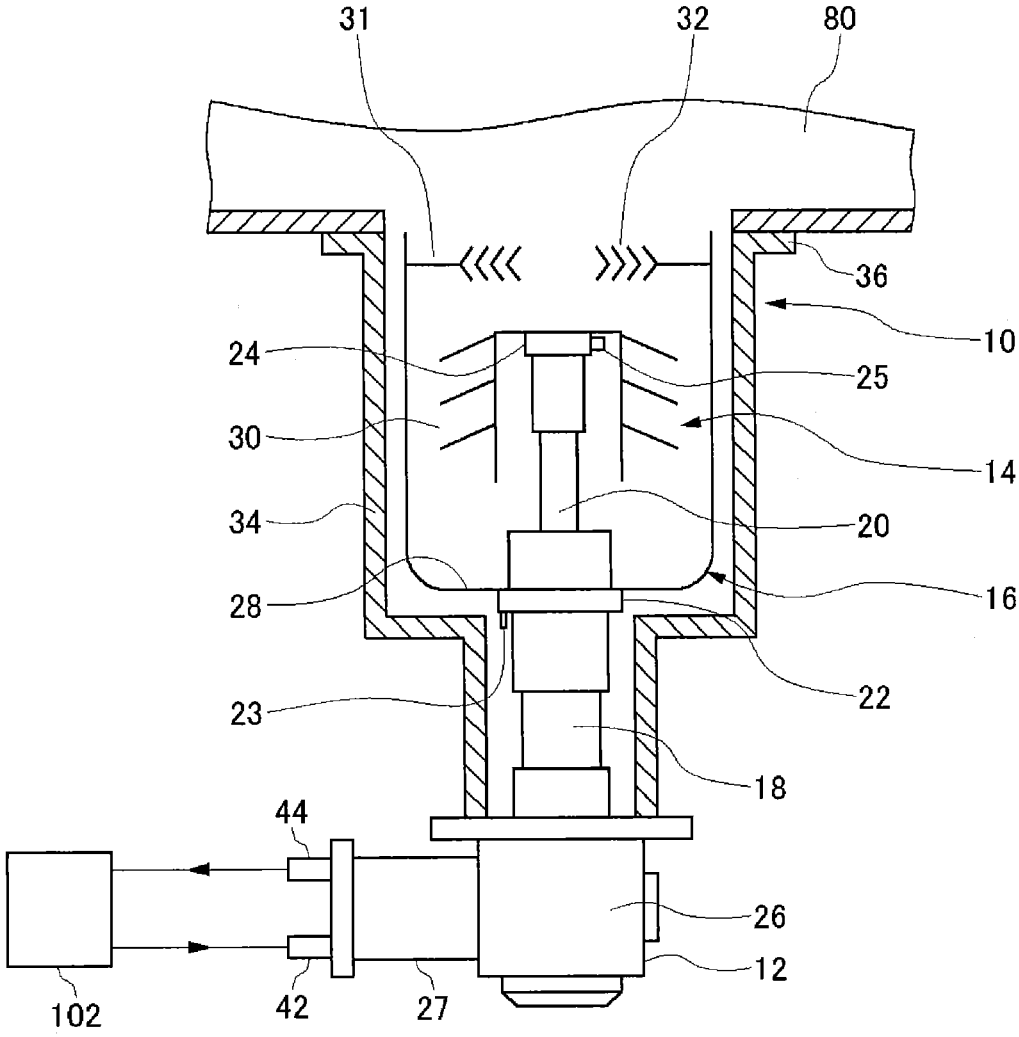
FIG. 2 is a diagram schematically illustrating the cryopump according to an embodiment of the invention.

FIG. 2 is a cross-sectional view schematically illustrating the cryopump 10 according to an embodiment of the invention. The cryopump 10 is attached to a vacuum chamber 80. The vacuum chamber 80 is, for example, a vacuum chamber of the beam line unit 4 or the end station unit 5 (see FIG. 1).

The cryopump 10 includes a first cryopanel which is cooled to a first cooling temperature level and a second cryopanel which is cooled to a second cooling temperature level lower than the first cooling temperature level. On the first cryopanel, a gas which has a low vapor pressure at the first cooling temperature level is captured by condensation and is evacuated. For example, a gas which has a vapor pressure lower than a reference vapor pressure (for example, $10^{-8}$ Pa) is evacuated. On the second cryopanel, a gas which has a low vapor pressure at the second cooling temperature level is captured by condensation and is evacuated. The surface of the second cryopanel is provided with an adsorption area which is used to capture a non-condensable gas that is not condensed even at the second temperature level due to the high vapor pressure. The adsorption area is formed, for example, by providing an adsorbent on the panel surface. The non-condensable gas is adsorbed to the adsorption area cooled to the second temperature level and is evacuated. The non-condensable gas includes hydrogen.

The cryopump 10 illustrated in FIG. 2 includes a refrigerator 12, a panel structure 14, and a heat shield 16. The refrigerator 12 generates coldness through a thermal cycle in which an operating gas is supplied, expanded, and discharged. The panel structure 14 includes a plurality of cryopanels, and these panels are cooled by the refrigerator 12. The panel surface is provided with a cryogenic temperature surface which captures a gas by condensation or adsorption so as to pump out the gas. In general, an adsorbent such as charcoal which adsorbs a gas is provided on the surface (for example, the rear surface) of the cryopanel. The heat shield 16 is provided so as to protect the panel structure 14 from the ambient radiation heat.

The cryopump 10 is a so-called vertical cryopump. The vertical cryopump indicates a cryopump in which the refrigerator 12 is inserted and disposed along the axial direction of the heat shield 16. Furthermore, the invention may be also applied to a so-called horizontal cryopump. The horizontal cryopump indicates a cryopump in which a second cooling stage of a refrigerator is inserted and disposed in a direction (generally, an orthogonal direction) intersecting the axial direction of the heat shield 16. Furthermore, FIG. 1 schematically illustrates the horizontal cryopump 10.

The refrigerator 12 is a Gifford-McMahon type refrigerator (a so-called GM refrigerator). Further, the refrigerator 12 is a double-stage-type refrigerator, and includes a first cylinder 18, a second cylinder 20, a first cooling stage 22, a second cooling stage 24, and a refrigerator motor 26. The first cylinder 18 and the second cylinder 20 are connected in series to each other, and a first displacer and a second displacer (not illustrated) which are connected to each other are incorporated therein. A refrigerant is mounted in the first displacer and the second displacer. Furthermore, the refrigerator 12 may be a refrigerator other than the double-stage GM refrigerator. For example, a single-stage GM refrigerator may be used or a pulse tube refrigerator or a Solvay refrigerator may be used.

The refrigerator 12 includes a passage switching mechanism which periodically switches the passageway of the operating gas so as to periodically repeat the inflow and the outflow of the operating gas. The passage switching mechanism includes, for example, a valve unit and a driving unit which drives the valve unit. The valve unit is, for example, a rotary valve, and the driving unit is a motor which rotates the rotary valve. The motor may be, for example, an AC motor and a DC motor. Further, the passage switching mechanism may be a direct drive mechanism which is driven by the linear motor.

One end of the first cylinder 18 is provided with a refrigerator motor 26. The refrigerator motor 26 is provided inside a motor housing 27 which is formed in the end portion of the first cylinder 18. The refrigerator motor 26 is connected to the first displacer and the second displacer such that the first displacer and the second displacer are respectively movable in a reciprocating manner inside the first cylinder 18 and the second cylinder 20. Further, the refrigerator motor 26 is connected to a movable valve (not illustrated) such that the movable valve provided inside the motor housing 27 is rotatable normally and reversely.

The first cooling stage 22 is provided in the end portion near the second cylinder 20 in the first cylinder 18, that is, the connection portion between the first cylinder 18 and the second cylinder 20. Further, the second cooling stage 24 is provided in the terminal of the second cylinder 20. The first cooling stage 22 and the second cooling stage 24 are respectively fixed to the first cylinder 18 and the second cylinder 20 by, for example, soldering.

The refrigerator 12 is connected to a compressor 102 through a gas supply port 42 and a gas discharge port 44 which are provided outside the motor housing 27. The refrigerator 12 generates coldness in the first cooling stage 22 and the second cooling stage 24 in a manner such that a high pressure operating gas (for example, helium or the like) which is supplied from the compressor 102 expands therein. The compressor 102 collects the operating gas expanding in the refrigerator 12, pressurizes the operating gas again, and supplies the operating gas to the refrigerator 12.

Specifically, first, a high pressure operating gas is supplied from the compressor 102 to the refrigerator 12. At this time, the refrigerator motor 26 drives the movable valve inside the motor housing 27 in a state where the gas supply port 42 communicates with the internal space of the refrigerator 12. When the internal space of the refrigerator 12 is filled with the high pressure operating gas, the movable valve is switched by the refrigerator motor 26, so that the internal space of the refrigerator 12 communicates with the gas discharge port 44. Accordingly, the operating gas expands and the expanding operating gas is collected by the compressor 102. In synchronization with the operation of the movable valve, the first displacer and the second displacer respectively move in a reciprocating manner inside the first cylinder 18 and the second cylinder 20. By repeating such a thermal cycle, the refrigerator 12 generates coldness in the first cooling stage 22 and the second cooling stage 24.

The second cooling stage 24 is cooled to a temperature lower than that of the first cooling stage 22. The second cooling stage 24 is cooled to, for example, a range from 10 K to 20 K or so, and the first cooling stage 22 is cooled to, for example, a range from 80 K to 100 K or so. A first temperature sensor 23 which measures the temperature of the first cooling stage 22 is attached to the first cooling stage 22, and a second temperature sensor 25 which measures the temperature of the second cooling stage 24 is attached to the second cooling stage 24.

The heat shield 16 is fixed to the first cooling stage 22 of the refrigerator 12 while being thermally connected thereto, and the panel structure 14 is fixed to the second cooling stage 24 of the refrigerator 12 while being thermally connected thereto. For this reason, the heat shield 16 is cooled to a temperature which is substantially equal to the temperature of the first cooling stage 22, and the panel structure 14 is cooled to a temperature which is substantially equal to the temperature of the second cooling stage 24. The heat shield 16 is formed in a cylindrical shape of which one end is provided with an opening portion 31. The opening portion 31 is defined by the inner surface of the end portion of the cylindrical side surface of the heat shield 16.

On the other hand, a blocking portion 28 is formed at the other end on the opposite side of the opening portion 31 in the heat shield 16, that is, the bottom side of the pump. The blocking portion 28 is formed by a flange portion which extends radially inward from the bottom end of the cylindrical side surface of the heat shield 16. Since the cryopump 10 illustrated in FIG. 2 is a vertical cryopump, the flange portion is attached to the first cooling stage 22 of the refrigerator 12. Accordingly, a columnar internal space 30 is formed inside the heat shield 16. The refrigerator 12 protrudes toward the internal space 30 along the axis of the heat shield 16, and the second cooling stage 24 is inserted into the internal space 30.

Furthermore, in the case of the horizontal cryopump, the blocking portion 28 is generally blocked completely. The refrigerator 12 is disposed so as to protrude toward the internal space 30 along the direction perpendicular to the axis of the heat shield 16 from the refrigerator attachment opening portion which is formed in the side surface of the heat shield 16. The first cooling stage 22 of the refrigerator 12 is attached to the refrigerator attachment opening portion of the heat shield 16, and the second cooling stage 24 of the refrigerator 12 is disposed in the internal space 30. The panel structure 14 is attached to the second cooling stage 24. Thus, the panel structure 14 is disposed in the internal space 30 of the heat shield 16. The panel structure 14 may be attached to the second cooling stage 24 with a panel attachment member of an appropriate shape.

Further, a baffle 32 is provided in the opening portion 31 of the heat shield 16. The baffle 32 is provided such that a gap is formed between the baffle and the panel structure 14 in the axial direction of the heat shield 16. The baffle 32 is attached to the end near the opening portion 31 of the heat shield 16, and is cooled to a temperature which is substantially equal to the temperature of the heat shield 16. The baffle 32 may be formed in, for example, a concentric shape or other shapes such as a lattice shape when seen from the vacuum chamber 80. Furthermore, the gate valve 7 (see FIG. 1) is provided between the baffle 32 and the vacuum chamber 80.

The heat shield 16, the baffle 32, the panel structure 14, and the first cooling stage 22 and the second cooling stage 24 of the refrigerator 12 are accommodated inside the pump casing 34. The pump casing 34 is formed by connecting two cylinders with different diameters in series to each other. The large-diameter end of the pump casing 34 is open, and the flange portion 36 to be connected to the vacuum chamber 80 extends outward in the radial direction. Further, the small-diameter end of the pump casing 34 is fixed to the motor housing 27 of the refrigerator 12. The cryopump 10 is gastightly fixed to the exhaust opening of the vacuum chamber 80 with the flange portion 36 of the pump casing 34, and forms a gastight space which is integrated with the internal space of the vacuum chamber 80. The pump casing 34 and the heat shield 16 are both formed in a cylindrical shape, and are coaxially disposed. Since the inner diameter of the pump casing 34 is slightly larger than the outer diameter of the heat shield 16, the heat shield 16 is disposed such that a slight gap is formed between the heat shield 16 and the inner surface of the pump casing 34.

In order to initiate the operation of the cryopump 10, first, the inside of the vacuum chamber 80 is adjusted to a range from 1 Pa to 10 Pa or so by using the other appropriate roughing pump before the operation. Subsequently, the cryopump 10 is operated. The first cooling stage 22 and the second cooling stage 24 are cooled with the driving of the refrigerator 12, and the heat shield 16, the baffle 32, and the panel structure 14 which are thermally connected thereto are also cooled. The first cryopanel includes the heat shield 16 and the baffle 32, and the second cryopanel includes the panel structure 14.

The cooled baffle 32 cools gas molecules which fly from the vacuum chamber 80 into the cryopump 10, condenses a gas (for example, moisture or the like) of which a vapor pressure sufficiently decreases at the cooling temperature on the surface, and evacuates the condensed gas. A gas of which a vapor pressure does not sufficiently decrease at the cooling temperature of the baffle 32 passes through the baffle 32 and enters into the heat shield 16. Of the gas molecules entered, a gas (for example, argon or the like) of which a vapor pressure sufficiently decreases at the cooling temperature of the panel structure 14 is condensed on the surface of the panel structure 14 and is evacuated. A gas (for example, hydrogen or the like) of which a vapor pressure does not sufficiently decreases even at the cooling temperature is adsorbed onto the adsorbent adhered and cooled in the surface of the panel structure 14 and is evacuated. In this way, the cryopump 10 may achieve the vacuum degree inside the vacuum chamber 80 to a desired level.

Figure 3:
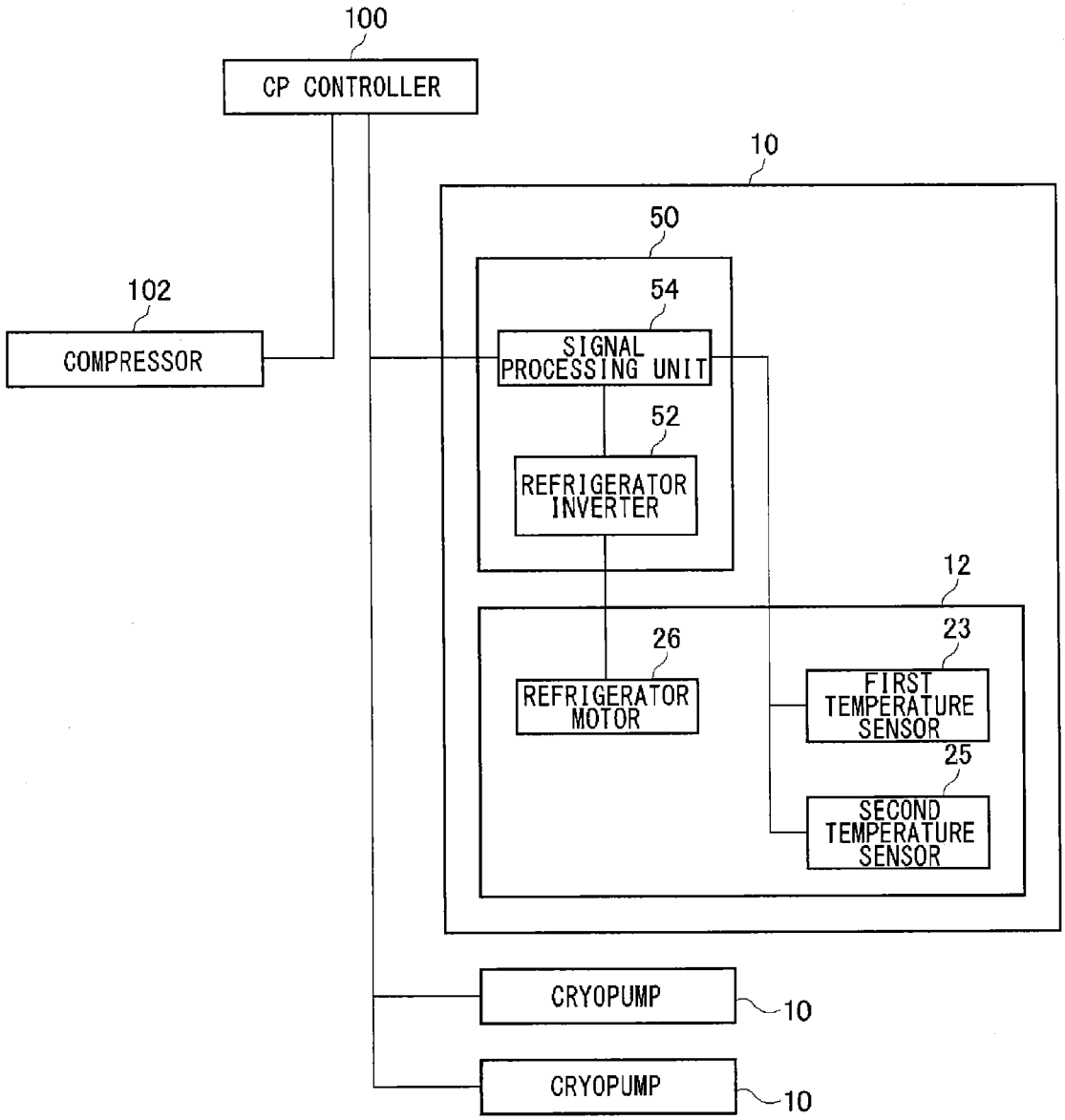
FIG. 3 is a control block diagram illustrating the cryopump according to an embodiment of the invention.

FIG. 3 is a control block diagram illustrating the cryopump 10 according to an embodiment of the invention. The components relating to the embodiment with respect to one of the plurality of cryopumps 10 are illustrated, and the other cryopumps 10 are not illustrated due to the same configuration. In the same way, the specific description of the compressor 102 will not be shown.

As described above, the CP controller 100 is connected to the IO module 50 of each cryopump 10 so as to be able to communicate therewith. The IO module 50 includes a refrigerator inverter 52 and a signal processing unit 54. The refrigerator inverter 52 adjusts electrical power of a prescribed voltage and a prescribed frequency supplied from an external power supply, for example, a commercial power supply, and supplies the adjusted electrical power to the refrigerator motor 26. The voltage and the frequency to be supplied to the refrigerator motor 26 are controlled by the CP controller 100.

The CP controller 100 determines the control output based on the sensor output signal. The signal processing unit 54 relays the control output transmitted from the CP controller 100 to the refrigerator inverter 52. For example, the signal processing unit 54 converts a control signal from the CP controller 100 into a signal which may be processed in the refrigerator inverter 52, and transmits the converted signal to the refrigerator inverter 52. The control signal includes a signal which represents the operating frequency of the refrigerator motor 26. Further, the signal processing unit 54 relays the outputs of various sensors of the cryopump 10 to the CP controller 100. For example, the signal processing unit 54 converts a sensor output signal into a signal which may be processed by the CP controller 100, and transmits the converted signal to the CP controller 100.

Various sensors including the first temperature sensor 23 and the second temperature sensor 25 are connected to the signal processing unit 54 of the 10 module 50. As described above, the first temperature sensor 23 measures the temperature of the first cooling stage 22 of the refrigerator 12, and the second temperature sensor 25 measures the temperature of the second cooling stage 24 of the refrigerator 12. The first temperature sensor 23 and the second temperature sensor 25 respectively measure periodically the temperatures of the first cooling stage 22 and the second cooling stage 24, and output signals representing the measured temperatures. The measurement values of the first temperature sensor 23 and the second temperature sensor 25 are input to the CP controller 100 at a predetermined time interval, and are stored in a predetermined storage area of the CP controller 100.

The CP controller 100 controls the refrigerator 12 based on the temperature of the cryopanel. The CP controller 100 transmits an operation command to the refrigerator 12 such that the actual temperature of the cryopanel follows the target temperature. For example, the CP controller 100 controls the operating frequency of the refrigerator motor 26 through a feed-back control so as to minimize a deviation between the target temperature of the first cryopanel and the measured temperature of the first temperature sensor 23. The frequency of the thermal cycle of the refrigerator 12 is determined in accordance with the operating frequency of the refrigerator motor 26. The target temperature of the first cryopanel is determined as, for example, a specification in accordance with a process performed in the vacuum chamber 80. In this case, the second cooling stage 24 of the refrigerator 12 and the panel structure 14 are cooled to a temperature which is determined by the specification of the refrigerator 12 and the external thermal load.

When the measured temperature of the first temperature sensor 23 is higher than the target temperature, the CP controller 100 outputs a command value to the IO module 50 such that the operating frequency of the refrigerator motor 26 increases. The frequency of the thermal cycle in the refrigerator 12 increases in synchronization with an increase in the motor operating frequency, and the first cooling stage 22 of the refrigerator 12 is cooled toward the target temperature. On the contrary, when the measured temperature of the first temperature sensor 23 is lower than the target temperature, the operating frequency of the refrigerator motor 26 decreases, so that the temperature of the first cooling stage 22 of the refrigerator 12 increases toward the target temperature.

In general, the target temperature of the first cooling stage 22 is set to a constant value. Thus, the CP controller 100 outputs a command value such that the operating frequency of the refrigerator motor 26 increases when the thermal load to the cryopump 10 increases, and outputs a command value such that the operating frequency of the refrigerator motor 26 decreases when the thermal load to the cryopump 10 decreases. Furthermore, the target temperature may be appropriately changed. For example, the target temperature of the cryopanel may be sequentially set such that a target ambient pressure is realized in a volume to be evacuated. Further, the CP controller 100 may control the operating frequency of the refrigerator motor 26 such that the actual temperature of the second cryopanel matches the target temperature.

In a typical cryopump, the frequency of the thermal cycle is set to be constant at all times. The operation mode is set such that the cryopump is operated at a comparatively large frequency so as to be rapidly cooled from the normal temperature to the pump operation temperature, and the temperature of the cryopanel is adjusted by the heating using a heater when the external thermal load is small. Thus, the power consumption increases. On the contrary, in the embodiment, since the thermal cycle frequency is controlled in accordance with the thermal load to the cryopump 10, the cryopump which has an excellent energy saving performance may be realized. Further, the fact that the heater does not need to be necessarily provided contributes to a reduction in the power consumption.

Incidentally, the ion implantation apparatus 1 has various operation states. Hereinafter, this will be referred to as an operation mode. A plurality of operation modes of the ion implantation apparatus 1 include an irradiation mode and an idle mode. In the irradiation mode, the ion implantation apparatus 1 irradiates an ion beam to the substrate 8 for the ion implantation. A main controller 11 of the ion implantation apparatus 1 controls the ion beam in accordance with a target intensity of the ion beam which is set for the ion implantation process.

In the idle mode, the ion implantation apparatus 1 may bend the ion beam such that the ion beam is diverted from the irradiation target, for example, the substrate 8. That is, the ion implantation apparatus 1 may irradiate the ion beam to the outside of the substrate while keeping irradiating the ion beam. The intensity level of the ion beam may be set to the same level as that of the irradiation mode. In the idle mode, the ion beam maybe diverted from the target, and be irradiated to a beam receiver, for example, a carbon fiber plate so as to evacuate or keep the beam in a standby state. The beam receiver may be provided in the beam line unit 4 or the end station unit 5. For example, the beam receiver may be provided in a substrate holder which holds the substrate 8 or the vicinity thereof.

In the idle mode, the ion implantation apparatus 1 may keep the ion beam in the beam path 9 at a level weaker than that of the irradiation mode. In the idle mode, the irradiation of the ion beam of which an intensity is lower than that of the irradiation mode may be continued. Instead of completely blocking the ion beam, a very weak ion beam is kept in the beam path 9. The ion beam with a weak intensity may be irradiated to the target or be diverted from the target so as to be irradiated to a beam receiver, for example, a carbon fiber plate.

For example, the operation mode switches to the idle mode between the irradiation mode and the next irradiation mode. When the substrate 8 subjected to the ion implantation process is replaced by another substrate 8 to be processed at the next time, the idle mode may be selected. In the idle mode, the substrate 8 is not normally present at the terminal of the beam path 9, but may be present at the terminal.

The main controller 11 is in charge of such an operation of switching the operation mode. The main controller 11 switches the operation mode depending on the circumstance. The main controller 11 transmits a control signal representing the selected operation mode to the CP controller 100. The CP controller 100 may receive the control signal representing the operation mode from the ion implantation apparatus 1, and controls the cryopump 10 based on the control signal. The CP controller 100 controls the refrigerator 12 based on the control signal representing the operation mode in order to control the temperature of the cryopanel.

The cryopump 10 for the ion implantation apparatus 1 mainly evacuates a hydrogen gas as described above. In order to improve the throughput of the ion implantation process of the ion implantation apparatus 1, the cryopump 10 capable of rapidly evacuating a hydrogen gas has been demanded.

Figure 4:
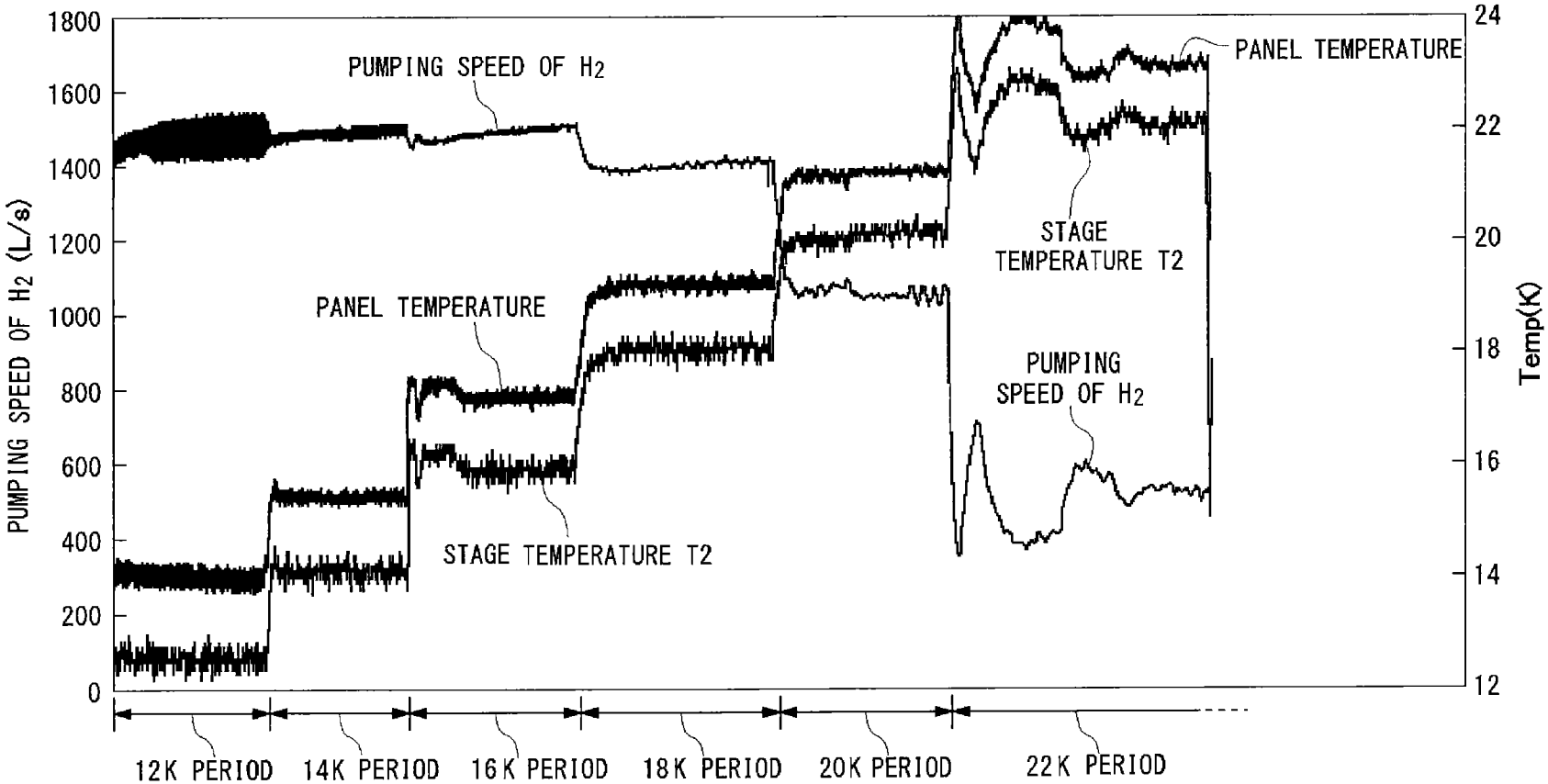
FIG. 4 is a graph illustrating a relation between a temperature of a cryopanel for evacuating a hydrogen gas and the pumping speed of the hydrogen gas.

FIG. 4 is a graph illustrating a relation between the temperature of the cryopanel for evacuating a hydrogen gas and the pumping speed of the hydrogen gas in an experimental example. The temperature value is indicated by the right vertical axis of FIG. 4. The left vertical axis indicates the pumping speed of the hydrogen gas. The horizontal axis indicates the time. As described below in detail, the present inventor has found that a certain relation is established between an amount of temperature increasing of the cooling stage and the cryopanel for evacuating the hydrogen gas, and a decreasing amount of the pumping speed of the hydrogen gas.

In this experimental example, a comparatively small cryopanel structure was used, and the setting temperature of the second cooling stage 24 was gradually increased by the unit of 2 K. Then, a change in the pumping speed of the hydrogen gas was checked. The initial value of the target temperature of the second cooling stage 24 was 12 K, and the target temperature was sequentially increased to 14 K, 16 K, 18 K, 20 K, and 22 K. The measurement value of the stage temperature T2 gradually increases in accordance with the temperature increasing operation.

In the following description, for convenience of description, the periods in the respective target temperatures XK are referred to as XK periods. That is, this experimental example was started from 12 K period, and 14 K period, 16 K period, 18 K period, 20 K period, and 22 K period were sequentially continued. Furthermore, as illustrated in FIG. 4, the length of each period is different for each period, but the result and the analysis of the experimental example are not dependent thereon.

FIG. 4 illustrates a measured temperature of the terminal portion (that is, a comparatively high temperature portion which is distant from the stage) of the second cryopanel used in this experimental example in addition to the measurement value of the stage temperature T2. The temperature of the terminal portion of the panel gradually increases as in the stage temperature. However, since the terminal portion of the cryopanel is distant from the cooling stage, the temperature of the terminal portion is higher than that of the cooling stage by a certain extent. In this experimental example, the panel temperature measurement value is higher than the stage temperature T2 by about 1.5 K. Furthermore, a minute variation (of about 0.2 K at maximum) in the temperature measurement value illustrated in FIG. 4 is found, but the variation in the temperature is within a range which may be regarded as a constant temperature in fact.

Experientially, it is estimated that the temperature of the terminal portion of the panel of a small cryopanel structure is higher than the stage temperature by about 1 K and the temperature of the terminal portion of the panel of a large cryopanel structure is higher than the stage temperature by about 2 K. In the maximal cryopanel structure which is supposed in the cryopump used for the ion implantation apparatus, the temperature of the terminal portion may be higher than the stage temperature by about 3 K.

As understood from FIG. 4, even when the stage temperature increases from 12 K period to 16 K period, the pumping speed of the hydrogen gas is maintained at the initial high level (for example, about 1500 L/s). The high temperature portion of the cryopanel (in FIG. 4, the panel temperature) is about 17.5 K at maximum in the 16 K period. Thus, it is desirable that the temperature of the high temperature portion of the cryopanel is suppressed to be equal to or lower than about 17.5 K in order to rapidly evacuate the hydrogen gas. As for the stage temperature, it is desirable that the stage temperature is suppressed to be equal to or lower than about 16 K in order to rapidly evacuate the hydrogen gas in this experimental example.

In the 18 K period, the pumping speed of the hydrogen gas is about 1400 L/s, which is slightly slower than that of the 16 K period. The pumping speed may be enough for the practical use, but may not be essentially enough for realizing the high throughput of the ion implantation apparatus 1. In the 18 K period, the temperature of the high temperature portion of the terminal portion of the cryopanel is about 19.5K. When the current period transfers to the 20 K period, the pumping speed further greatly decreases so as to be from about 1000 to 1100 L/s. In the 20 K period, the temperature of the high temperature portion of the cryopanel is about 21.5 K. In the 22 K period, the status is not stable, so that the experiment is stopped. This is because at least the high temperature portion of the cryopanel exceeds the temperature range in which the hydrogen gas may be adsorbed and held.

Thus, from the viewpoint of a change in the pumping speed due to the temperature, the cooling stage temperature may be divided into three temperature ranges. The first temperature range is a low temperature range where the high speed pumping speed is sufficiently guaranteed. In the experimental example of FIG. 4, 12 K, 14 K, and 16 K are included in this temperature range. It may be considered that 18 K is also included in this temperature range. The second temperature range is a high temperature range which is regarded that the practical pumping cannot be performed. The gas which is captured on the surface of the panel is vaporized again. In the experimental example of FIG. 4, 22 K is included in this temperature range.

The third temperature range is an intermediate temperature range between the first and second temperature ranges. In this temperature range, the pumping speed of the highest level may not be provided, but the gas molecules which are captured on the surface of the cryopanel may be stably held. That is, there is a limitation in the capability of adsorbing new gas molecules onto the surface of the cryopanel, but the gas molecules which are already adsorbed thereon may be continuously held. In the experimental example of FIG. 4, 20 K is included in this temperature range. It may be considered that 18 K is also included in this temperature range.

As long as the temperature of the cooling stage is maintained in the first temperature range, the pumping speed is maintained at a high level. Then, when the temperature of the cooling stage exceeds the temperature range, the pumping speed decreases. The first temperature range is a temperature range where the high-speed pumping may be performed. In the temperature range which enables the high speed pumping, an amount of decreasing the pumping speed with respect to temperature increasing is substantially zero or sufficiently small. On the contrary, at the temperature which exceeds the temperature range, an amount of decreasing the pumping speed with respect to temperature increasing becomes noticeable. However, in the third temperature range which does not excessively exceeds the first temperature range, the gas which adheres to the cryopanel may be stably held.

Incidentally, when it is expected that the thermal load generated in the cryopump 10 due to the ion beam in the idle mode of the ion implantation apparatus 1 is sufficiently weak, the operation of the cryopump 10 may be stopped. Then, the power consumption of the system may be reduced. However, in general, even in the idle mode, a certain degree of thermal load is generated in the cryopump due to the existing beam. Thus, in order to suppress an increase in the temperature of the cryopanel due to the thermal load and prevent the captured hydrogen from being discharged from the cryopanel, it is desirable to continue the operation of the cryopump 10 even in the idle mode.

From the viewpoint of the throughput of the ion implantation apparatus 1, it is desirable that the hydrogen gas is evacuated in the irradiation mode at the sufficient pumping speed using the cryopump 10 and such a high-speed pumping is not necessarily needed in the idle mode. The pumping speed of the cryopump 10 is concerned with the power consumption, and there is a tendency for the electrical power to be further consumed as the pumping speed becomes faster.

Therefore, in an embodiment of the invention, the cryopump 10 allows the pumping speed, for example, the pumping speed of the hydrogen gas to be lower than that of the irradiation mode in at least a part of the period of the idle mode of the ion implantation apparatus 1. For this reason, in the method of controlling the cryopump 10 according to an embodiment, the CP controller 100 decreases the cooling capability or the cooling output of the refrigerator 12.

In an embodiment, the CP controller 100 controls the refrigerator 12 such that the cryopanel is cooled to a temperature equal to or lower than the cooling temperature at which the captured gas molecules are held in any one of the irradiation mode and the idle mode. The cryopanel includes an adsorbent which is able to adsorb a hydrogen gas, and the CP controller 100 controls the refrigerator 12 such that the cryopanel is cooled to a temperature range where the hydrogen gas is held by the adsorbent. The CP controller 100 allows the cooling temperature of the cryopanel to be higher than that of the irradiation mode in at least a part of the idle mode within the cooling temperature range.

Figure 5:
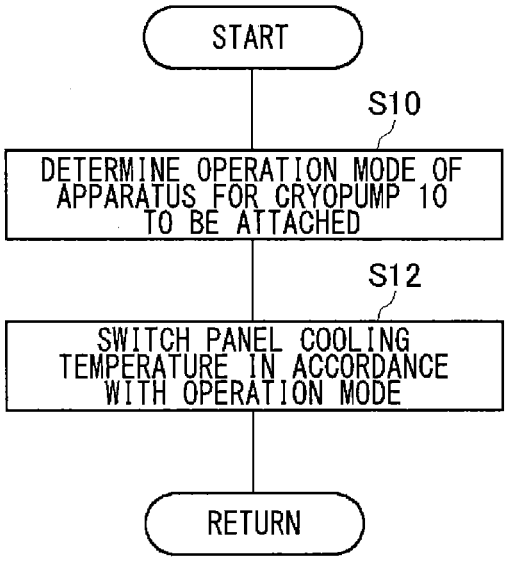
FIG. 5 is a flowchart illustrating the control process of the cryopump according to an embodiment of the invention.

FIG. 5 is a flowchart illustrating a control process of the cryopump 10 according to an embodiment of the invention. The CP controller 100 determines the operation mode of the ion implantation apparatus 1 to which the cryopump 10 is attached, and switches the target temperature of the second cooling stage 24 in accordance with the operation mode. This process is repeated during the operation of the cryopump 10.

As illustrated in FIG. 5, the CP controller 100 determines the operation mode of the apparatus, for example, the ion implantation apparatus 1, for the cryopump 10 to be attached (S10). The CP controller 100 determines at least whether the ion implantation apparatus 1 is in the irradiation mode or the idle mode based on the control signal which is received from the main controller 11 of the ion implantation apparatus 1.

The CP controller 100 switches the cooling temperature of the second cryopanel, for example, the target temperature of the second cooling stage 24 in accordance with the determined operation mode (S12). When the current operation mode is the same as the operation mode of the precedent process, the target temperature is kept. The current process is ended according to the setting of the target temperature. The CP controller 100 controls the cryopump 10 based on the target temperature. Specifically, for example, as described above, the operating frequency of the refrigerator 12 is adjusted.

In the setting of the target temperature, the CP controller 100 sets, for example, the cooling temperature of the second cryopanel, that is, the target temperature of the second cooling stage 24 to a temperature which is selected from the temperature range where the hydrogen gas is held by the adsorbent on the cryopanel, and desirably the upper limit value of the hydrogen holding temperature range. The upper limit value is, for example, the highest temperature of the third temperature range. The third temperature range is equal to or higher than 17 K and lower than 20 K, and desirably equal to or higher than 18 K and lower than 20 K. Thus, the CP controller 100 sets the target temperature of the second cooling stage 24 in the idle mode to, for example, 20 K. In order to save electrical power, it is desirable that the target temperature is set to a high temperature as much as possible.

On the other hand, the CP controller 100 sets the target temperature of the second cooling stage 24 in the irradiation mode to the target temperature which is selected from the first temperature range or the high speed pumping temperature range, for example, a temperature range equal to or higher than 10 K and lower than 17 K. Desirably, the CP controller 100 sets the target temperature which is selected from the temperature range equal to or higher than 10 K and lower than 15 K.

With such switching of the temperature, the temperature of the second cooling stage 24 may be increased to a temperature higher than that of the irradiation mode, for example, a temperature range equal to or higher than 17 K and lower than 20 K in the idle mode. This is because the operating frequency of the refrigerator 12 decreases with an increase in the target temperature. In this way, it is possible to reduce the power consumption through the irradiation mode and the idle mode compared to the case where the common cooling temperature is maintained.

As an example, the power consumption is reduced from about 10.2 kW to about 9 kW by about 12% in the case of the target temperature of 18 K through the simultaneous operation of four cryopumps 10 compared to the case of the target temperature of 15 K of the second cooling stage 24. In this way, it is possible to reduce the total power consumption of the evacuation system by reducing the power consumption in the period of the idle mode.

Further, since the temperature of the second cooling stage 24 increases to a temperature range equal to or higher than 17 K and lower than 20 K, the temperature of the high temperature portion of the terminal portion of the cryopanel becomes a temperature range equal to or higher than about 18 K and lower than 21 K in the case of the small cryopanel structure, and becomes a temperature range equal to or higher than about 19 K and lower than 22 K in the case of the large cryopanel structure. In such a temperature level, as understood from the experimental example illustrated in FIG. 4, the adhering hydrogen gas may be stably held in the cryopanel.

The present invention has been described above based on the embodiments. It should be appreciated by those skilled in the art that the invention is not limited to the above embodiments but various design changes and variations can be made, and such variations are also encompassed by the present invention.

In the above-described embodiments, the timing of switching the operation mode in the ion implantation apparatus 1 does not need to essentially match the timing of switching the target temperature using the CP controller 100. For example, the CP controller 100 may increase the target temperature compared to the irradiation mode in at least a part of the period of the idle mode. In order to cool the cryopanel before the operation mode of the ion implantation apparatus 1 is returned from the idle mode to the irradiation mode, the CP controller 100 may return the target temperature before the return to the irradiation mode.

Instead of changing the setting of the target temperature of the second cooling stage 24, the CP controller 100 may change the setting of the target temperature of the first cooling stage 22. Since the temperatures of two cooling stages are correlated with each other, it is possible to adjust the temperature of the second cooling stage 24 by changing the target temperature of the first cooling stage 22.

The CP controller 100 may directly change the setting of the operating frequency of the refrigerator 12 according to the operation mode instead of changing the setting of the temperature. For example, the operating frequency of the refrigerator 12 corresponding to the idle mode may be determined as a fixed value, and the CP controller 100 may control the refrigerator 12 at the fixed operating frequency in the idle mode. Alternatively, a different operating frequency range may be determined for each of the plurality of operation modes.

In the above-described embodiments, the ion implantation apparatus has been described as an example, but the application of the invention is not limited to the ion implantation apparatus. That is, the invention may be applied to a beam irradiating apparatus which irradiates a beam to a target. For example, the cryopump according to the embodiment may be a cryopump which is used to evacuate a beam path in a particle radiation treatment apparatus which irradiates a particle beam to an affected part so as to cure the affected part.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2011-90347, filed Apr. 14, 2011, the entire content of which is incorporated herein by reference.

What is claimed is:

1. A cryopump for use in evacuation of a beam path in a beam irradiating apparatus, the apparatus configured to irradiate a beam to a target, the cryopump comprising:

a cryopanel configured to capture gas molecules on a surface thereof;

a refrigerator configured to cool the cryopanel; and a control unit configured to receive a control signal from the beam irradiating apparatus representing an operation mode thereof and to control the refrigerator based on the control signal, wherein the operation mode includes an irradiation mode for irradiating a beam to a target and an idle mode for diverting the beam away from the target or keeping the beam with a level weaker than that of the irradiation mode, wherein the control unit controls the refrigerator such that the cryopanel is cooled to a cooling temperature at which the gas molecules are held in both the irradiation mode and the idle mode, wherein the control unit allows the cooling temperature in at least a part of a period of the idle mode to be higher than that of the irradiation mode.

2. The cryopump according to claim 1, wherein the control unit controls the refrigerator such that a cooling stage thereof thermally connected to the cryopanel is cooled to a temperature equal to or higher than 17 K and lower than 20 K in the at least a part of the period of the idle mode.

3. A method of evacuating a beam path using a cryopump, the method comprising:

irradiating a beam to a target; and instead of irradiating the beam to the target, keeping the beam by diverting the beam away from the target, or keeping the beam in the beam path with an intensity lower than that of the beam irradiated to the target, wherein the method further comprises setting a pumping speed of the cryopump in at least a part of a period of the keeping of the beam to be lower than that of the cryopump when the beam is irradiated to the target.

* * * * *